US011906255B1

(12) United States Patent
Smtih et al.

(10) Patent No.: US 11,906,255 B1
(45) Date of Patent: Feb. 20, 2024

(54) WEAPON ENERGY HARVESTING BY GAS TURBINE ELECTRIC GENERATOR

(71) Applicant: U.S. Government as Represented by the Secretary of the Army, Dover, NJ (US)

(72) Inventors: Alexander Smtih, Long Valley, NJ (US); Brian Hoffman, Bloomington, IN (US); Michael Colonnello, Mine Hill, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/965,921

(22) Filed: Oct. 14, 2022

(51) Int. Cl.
*F41A 13/10* (2006.01)
*F41A 19/08* (2006.01)

(52) U.S. Cl.
CPC ..... *F41A 13/10* (2013.01); *F41A 19/08* (2013.01)

(58) Field of Classification Search
CPC ..... F41A 13/10; F41A 19/08; F01D 15/10
See application file for complete search history.

(56) References Cited

U.S. PATENT DOCUMENTS 2,406,089 A * 8/1946 Martineau ..... F41F 3/048 42/76.01
3,041,939 A * 7/1962 Dardick ..... F41A 19/58 89/126
4,665,332 A * 5/1987 Meir ..... H02K 21/125 416/169 R
7,469,623 B1 * 12/2008 Olcott ..... F41A 19/08 89/27.3
8,686,576 B1 4/2014 Smith
2001/0031683 A1 * 10/2001 Schwertberger .... F16H 57/0486 475/331
2003/0217548 A1 * 11/2003 Sekihara ..... F02C 3/085 60/272
2004/0016226 A1 * 1/2004 Lawlor ..... F02C 3/085 60/39.35
2019/0145739 A1 * 5/2019 Jiang ..... F41G 5/06 89/41.05
2022/0090872 A1 * 3/2022 Overton ..... F25B 21/04

* cited by examiner

*Primary Examiner* — Andrew H Nguyen
(74) *Attorney, Agent, or Firm* — John P. DiScala

(57) ABSTRACT

A power generation assembly for a weapon system converts waste energy from a firing event to electric power. The power generation assembly directs expanding burning propellant gasses within the weapon system into a turbine array to generate electric current. The electric current is rectified to trickle charge a battery bank which then powers the weapon system.

1 Claim, 6 Drawing Sheets

WEAPON ENERGY HARVESTING BY GAS TURBINE ELECTRIC GENERATOR

STATEMENT OF GOVERNMENT INTEREST

The inventions described herein may be manufactured, used and licensed by or for the United States Government.

FIELD OF THE INVENTION

The invention relates in general to weapon systems and in particular to charging for remotely-operated weapons.

BACKGROUND OF THE INVENTION

Battlefield technology is ever improving, giving the warfighter ever increasing levels of lethality, survivability and situational awareness. These include hardware that individual soldiers carry or in high tech materiel solutions, such as remote weapon stations (RWS). However, with these new technologies comes increases in electricity demand to power the devices.

Battery storage capacity is continually increasing and battery volume decreasing. However, batteries still contribute significantly to the load of a soldier or system and are of no use when depleted.

Self-powered guns utilize the chemical energy in ammunition propellant to both accelerate the projectile for terminal effects and cycle the weapon, thereby enabling automatic or semi-automatic fire. As an example, the M240 medium machine gun, firing 7.62×51 mm NATO rounds, generates significant energy per shot. Of the roughly 10 kilojoules of energy contained in a single cartridge, over two-thirds of that energy is wasted as heat and gas pressure.

A need exists for a means to capture some of the excess energy from a weapon firing to generate power.

SUMMARY OF INVENTION

One aspect of the invention is a power generation assembly for a weapon system. The power generation assembly comprises a gas distribution subassembly, a turbine, an electrical generator and an electrical interface. The gas distribution subassembly receives expanding propellant gases from the weapon system barrel and further comprises a gas channel for directing propellant gas to a converging nozzle. The turbine is operable via propellant gases received from the converging nozzle. The electric generator further comprises a driveshaft about which torque is imparted by the turbine through an epicyclical gear arrangement. The driveshaft is coupled to a magnet rotor rotatably suspended within a generator stator. The electrical interface transmits an electric current produced by the magnet rotor rotating within the generator stator to trickle charge a battery.

Another aspect of the invention is a power generation assembly for a remote weapon system. The power generation assembly comprises a gas distribution subassembly, a right radial inflow turbine and a left radial inflow turbine, an electric generator subassembly and an electric interface. The gas distribution subassembly further comprises a gas tappet for receiving expanding propellant gases from the weapon system barrel, a right gas channel extending rearward to the right for directing propellant gas to a right converging nozzle and a left gas channel extending rearward to the left for directing propellant gas to a left converging nozzle. The right radial inflow turbine is operable via propellant gases received from the right converging nozzle and the left radial inflow turbine is operable via propellant gases received from the left converging nozzle. The right radial inflow turbine and the left radial inflow turbine are diametrically opposed to each other across a driveshaft. The electric generator subassembly further comprises the driveshaft about which a torque is imparted by the right radial inflow turbine and the left radial inflow turbine through an epicyclical gear arrangement. The driveshaft coupled to a magnet rotor rotatably suspended within a generator stator. The electrical interface for transmitting an electric current produced by the magnet rotor rotating within the generator stator to trickle charge a battery.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A power generation assembly for a weapon system converts waste energy from a firing event to electric power. The power generation assembly directs expanding burning propellant gasses within the weapon system into a turbine array to generate electric current. The electric current is rectified to trickle charge a battery bank which then powers the weapon system.

Advantageously, the power generation assembly harnesses waste energy and does not reduce the effectiveness of the weapon system. The power generation assembly is particularly suited for remote weapon systems (RWS) which require power for various interfaces, actuators and sensors to operate. However, it may also be adapted to conventional troop carried or mounted weapon systems.

Figure 1:
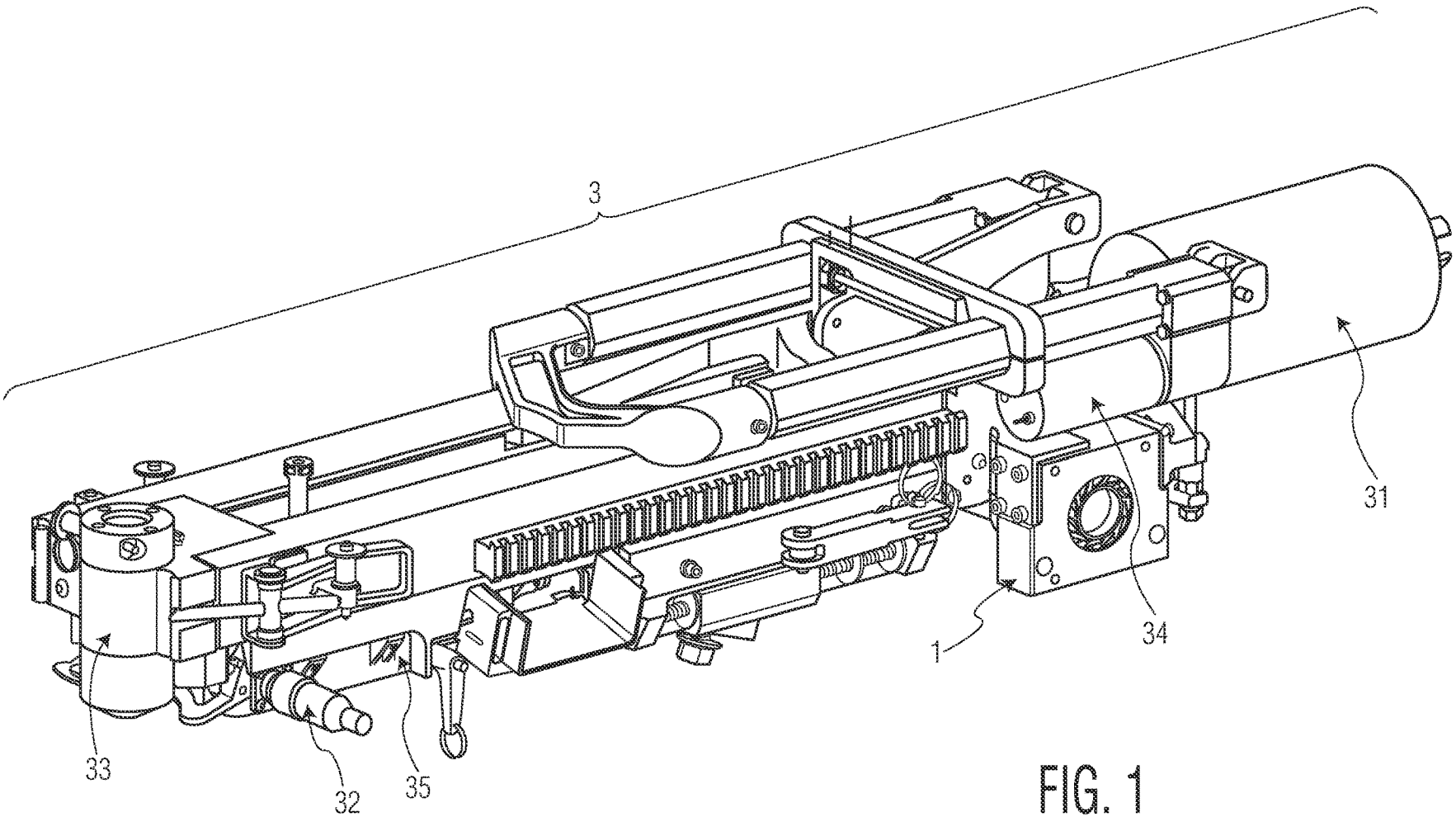
FIG. 1 shows a power generation assembly installed on a barrel of a remotely operated weapon, according to an illustrative embodiment.

FIG. 1 shows a power generation assembly installed on a barrel of a remotely operated weapon, according to an illustrative embodiment. The RWS 3 shown is configured to remotely fire small arms ammunition. For example, the RWS 3 may be configured to fire firing centerfire rifle cartridges. Rifle cartridge may denote a cartridge of the size typically employed by rifles such as FNP90, AR-15, or Mini-14 types such as 5.7×28 mm or .223 caliber. The weapon system may be configured to fire lower pressure, lower impulse pistol cartridges such as 9 mm or .45. However, the principles described above are not limited to this particular caliber or operating system. Those skilled in the art will appreciated that the RWS 3 may be adapted to fire other caliber ammunition.

Gimbals and actuators orient the muzzle of the RWS 3 via remote or autonomous actuation. The RWS 3 may comprise a hybrid operating system wherein the weapon is gas powered but comprises electronic actuators 34 to charge the weapon and clear jams and obstructions. Firing initiation and cadence is controlled by a firing solenoid 33. These functions are enabled by various sensors that relay information about the state of the weapon.

The power generation assembly 1 is mounted to a barrel 31 of the remote weapon system at the gun-tube gas port. Subsequent to a firing event, the power generation assembly 1 generates electric current which is transmitted from the power generation assembly 1 via an electric connection 32 through the base and gimbal of the RWS 3 to a battery bank. The battery bank, in turn, helps to power said gimbal, the firing solenoid 33, remote charging actuators 34 and sensors 35 that relay information about the state of the weapon. Additional functions can be powered as needed.

Figure 2:
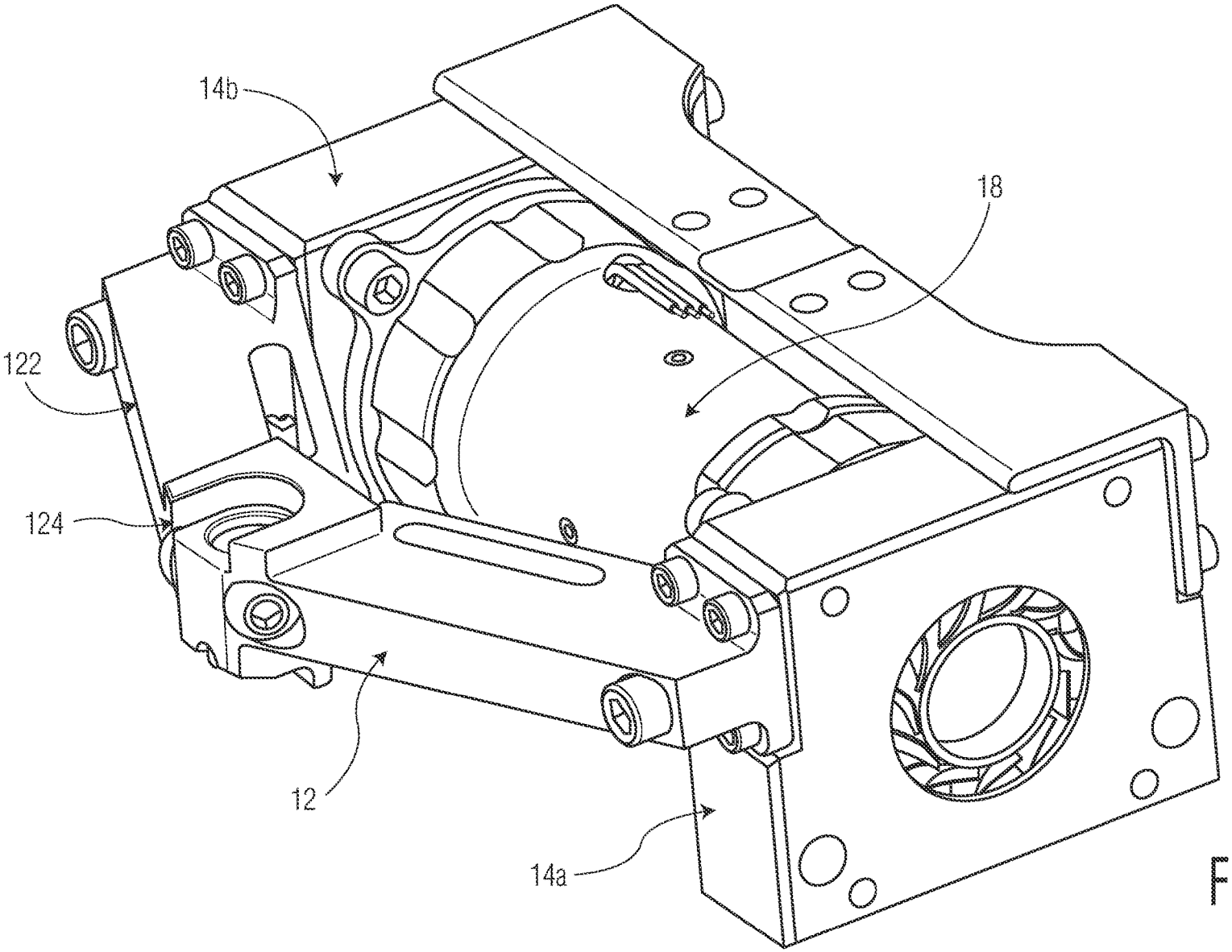
FIG. 2 is an isometric view of the power generation assembly, according to an illustrative embodiment.
Figure 3:
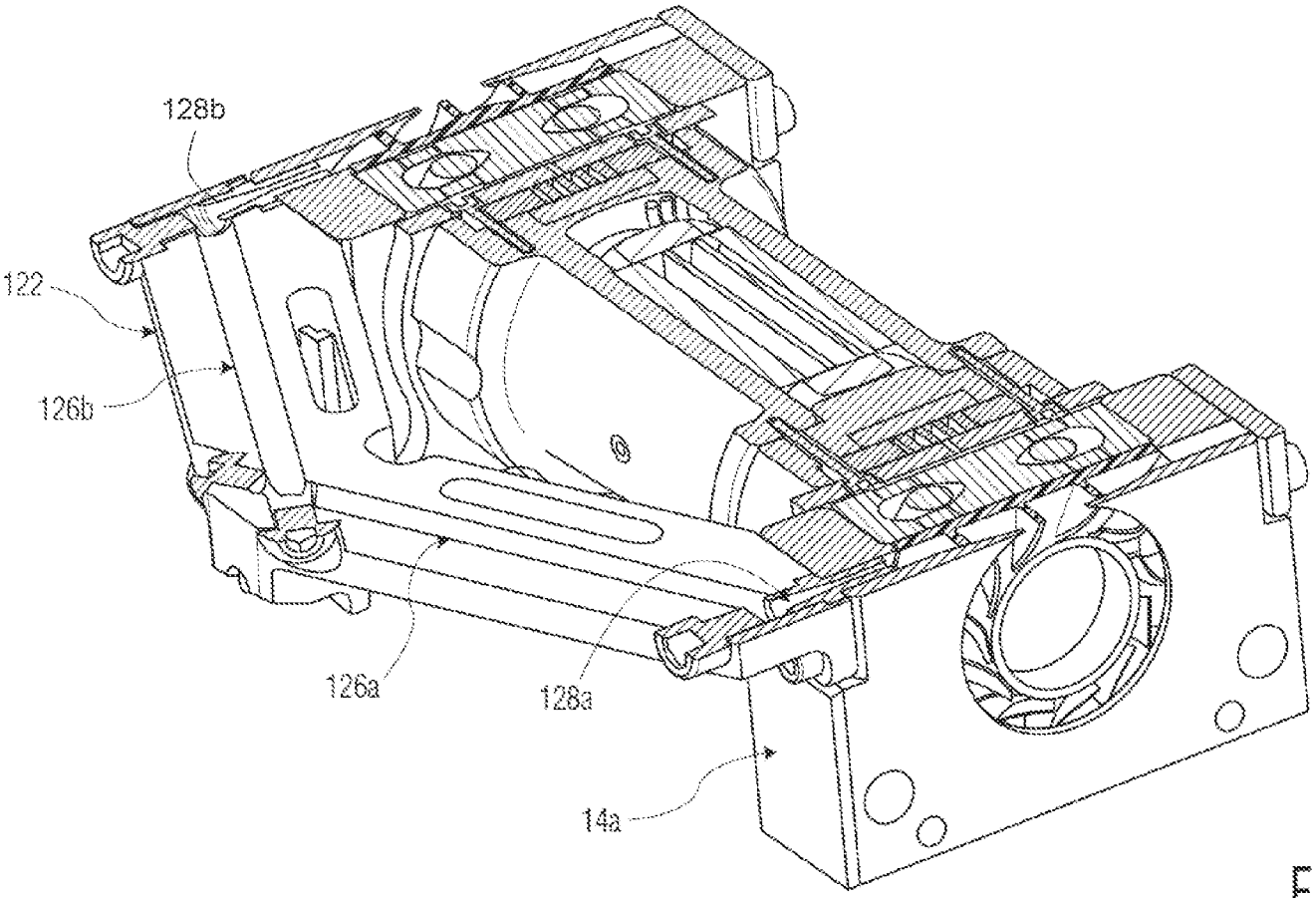
FIG. 3 is a partially cutaway view of the power generation assembly of FIG. 2, according to an illustrative embodiment.
Figure 4:
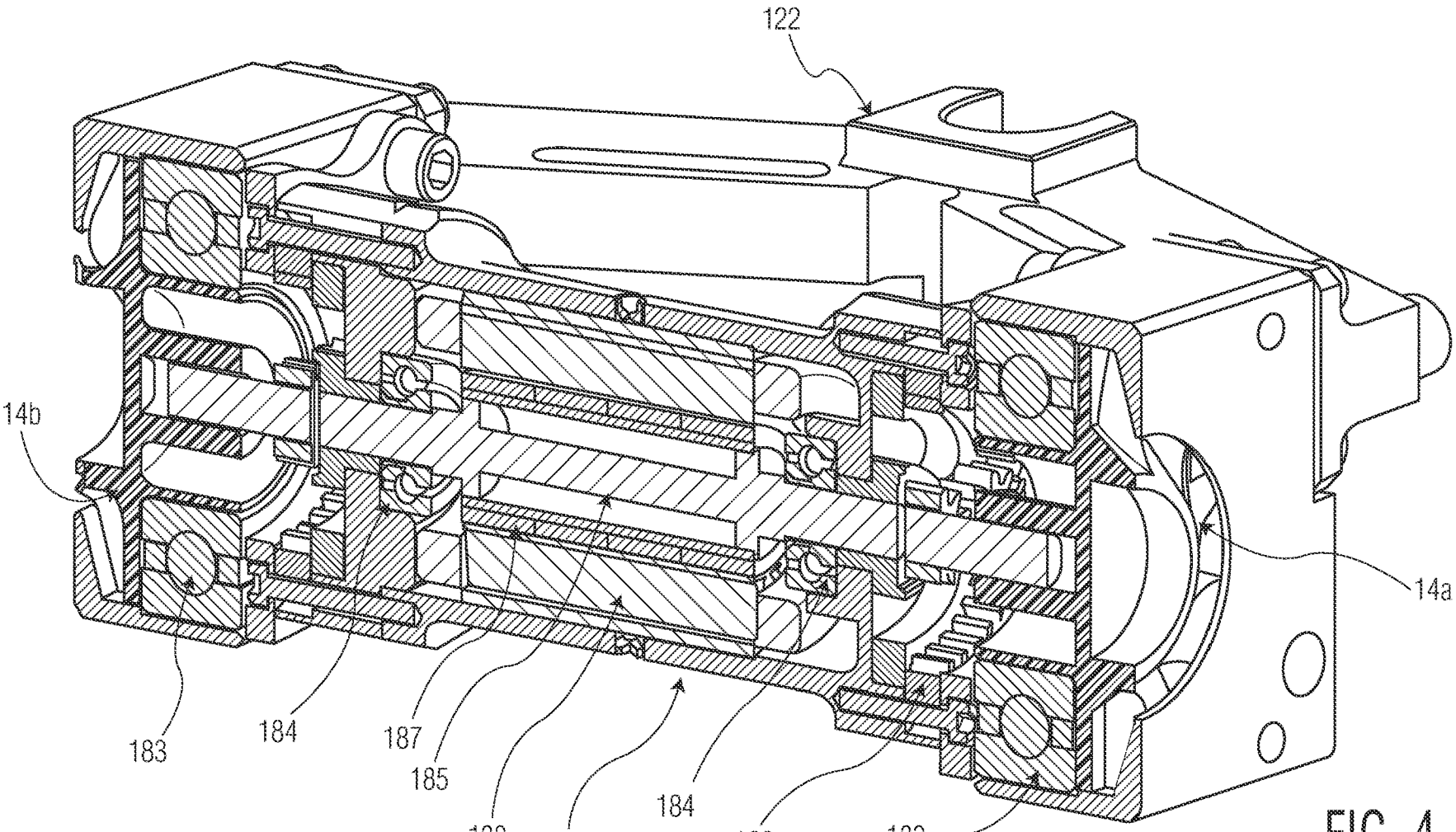
FIG. 4 is a cross-sectional view of the power generation assembly of FIG. 2, according to an illustrative embodiment.

FIG. 2 is an isometric view of the power generation assembly, according to an illustrative embodiment. FIG. 3 is a partially cutaway view of the power generation assembly of FIG. 2, according to an illustrative embodiment. FIG. 4 is a cross-sectional view of the power generation assembly of FIG. 2, according to an illustrative embodiment.

The power generation assembly 1 comprises a distributor subassembly 12, a right turbine 14*a*, a left turbine 14*b* and a generator subassembly 18. The distributor assembly 12 is forward of and connected to the right turbine 14*a* and the left turbine 14*b* and is in fluid communication with both. The right turbine 14*a* and left turbine 14*b*, in turn, are each connected to diametrically opposite sides of the generator subassembly 18 with the generator subassembly 18 positioned between the two turbines 14. Internal components of the right turbine 14*a* and the left turbine 14*b* are mechanically coupled to components of the generator subassembly 18.

The distributor subassembly 12 further comprises a distributor housing 122, a gas tappet 124 and dual gas channels 126. The gas tappet 124 is located at a front end of the distributor housing 122 and is located proximate to the weapon barrel 31 when the power generator assembly 1 is mounted to the barrel 31 of the RWS 3. The gas tappet 124 selectively allows a portion of the expanding propellant gases from the barrel 31 to enter the distributor housing 122.

The distributor housing 122 defines dual gas channels 126, a right channel 126*a* extending through the housing rearward and to the right and a left channel 126*b* extending through the housing rearward and the left. Each of the dual gas channels 126 terminates at a converging nozzle 128. Beneficially, the dual gas channels are angled as opposed to being at right angles to reduce the head losses as the barrel gas travels from the gun barrel 31 into the system.

The right converging nozzle 128*a* and left converging nozzle 128*b* accelerates the propellant gases into the right turbine 14*a* and left turbine 14*b*, respectively. Each converging nozzle 128 comprises a constricting orifice that throttles the gas into the respective turbine 14. The entrance and exit planes of the converging nozzles 128 have specifically designed cross sectional areas to efficiently convert heat and pressure into high velocity gas to provide kinetic energy into the impingement veins of the impeller.

Figure 5:
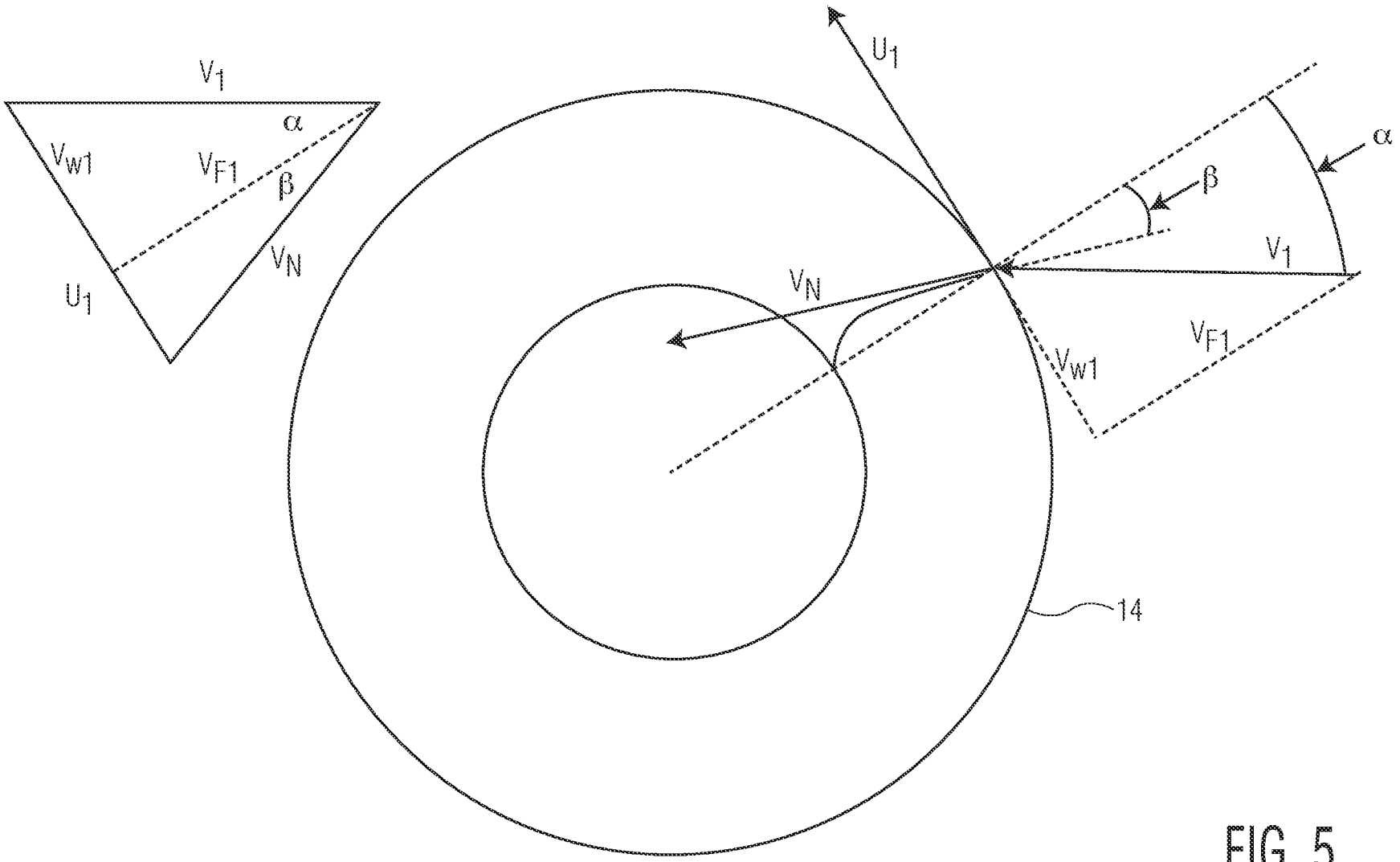
FIG. 5 shows a turbine blade of one of the dual turbines of FIG. 2 in schematic, according to an illustrative embodiment.

FIG. 5 shows a turbine blade of one of the dual turbines in schematic, according to an illustrative embodiment. The right turbine 14*a* and the left turbine 14*b* are radial inflow gas turbines. The power generation assembly 1 employs dual turbines 14 to balance the mass along the gun and prevent lopsided distribution of weight which may affect performance of the weapon system. In addition, by employing multiple turbines, the individual gas channels 126 can be smaller without sacrificing the total volume of gas delivered. While the invention is shown using two turbines 14, the invention may employ more or less than two turbines.

The flow is evenly matched between the right turbine 14*a* and left turbine 14*b* since the combined torque of the two turbines 14 spin the power generation shaft. Small variations in angular speed between the two shafts transmitting power to the main power generation shaft are balanced out by the inherent backlash in the gearbox.

While the invention is shown and described as using radial inflow gas turbines, those skilled in the art will appreciate that the power generation assembly 1 may be modified to accommodate other turbines, such as axial flow turbines. The accelerated propellant gas is applied to the blades of the turbines 14 tangentially on the blade diameter which cause the turbines 14 to rotate.

The generator subassembly 18 further comprises a generator housing 182, inner bearings 183, outer bearings 184, a driveshaft 185, an epicyclical gear assembly 186, a permanent magnet rotor 187, a generator stator 188. Each turbine 14 is mechanically coupled to a driveshaft 185 of the generator subassembly 18 via an epicyclical gear assembly 186. Rotation of the turbines 14 cause the driveshaft 185 to rotate which in turn spins the permanent magnet rotor 187 within the generator stator 188. The inner bearings 183 and outer bearings 184 support the driveshaft 185 and maintain rotor concentricity with the generator stator 188.

The gear reduction ratio of the epicyclical gear assembly 186 is designed to be tuned to the generator subassembly 18. The gear reduction is designed such that the gross rotational displacement of the two turbine shafts is converted into a speed and torque that match the most efficient power transmission coefficients (rotation speed into voltage and torque into current) of the generator.

Rotation of the permanent magnet rotor 187 within the generator stator 188 generates an electric current. The electric current is rectified to trickle charge a battery bank which then powers the weapon system.

Figure 6:
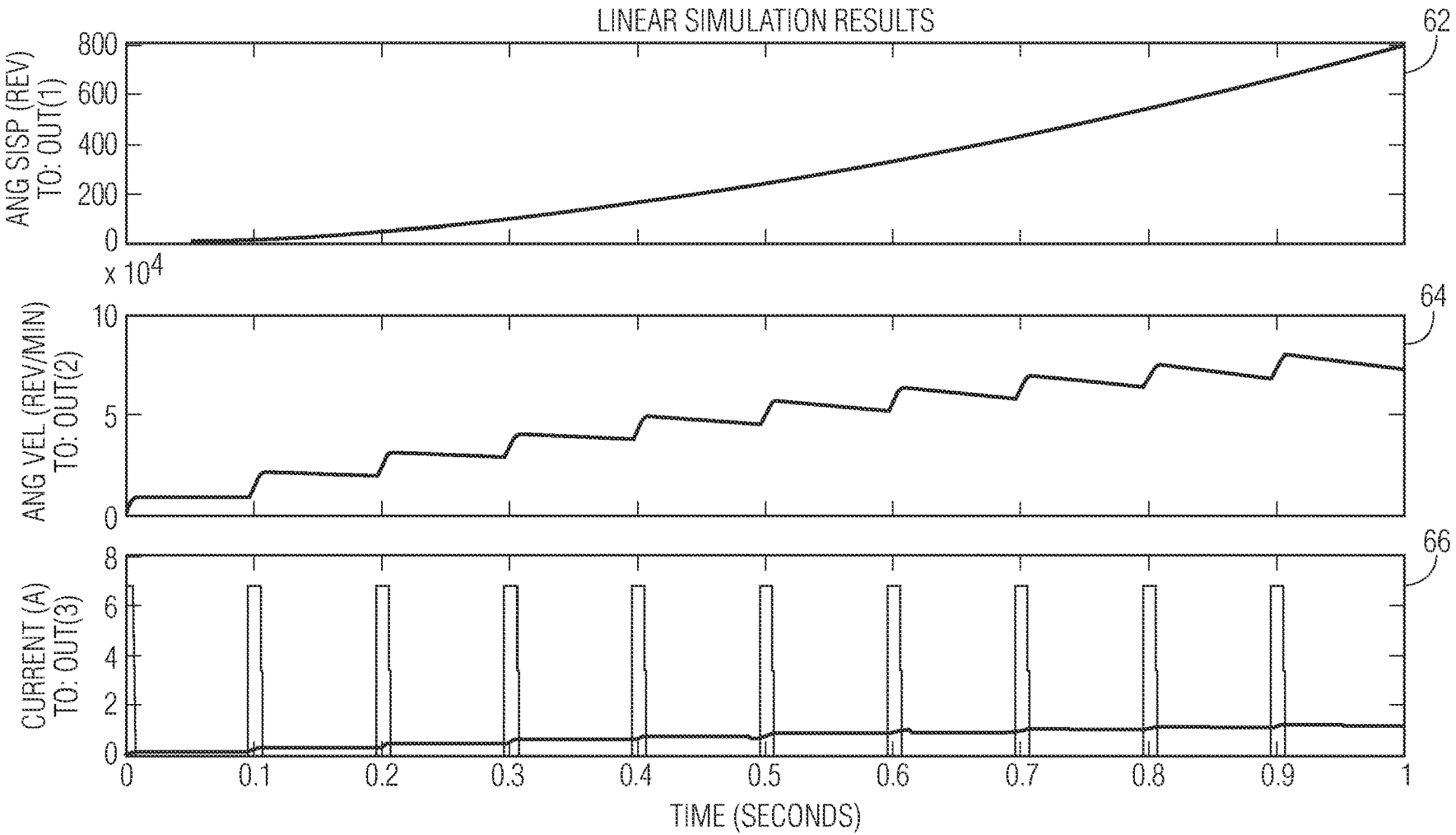
FIG. 6 is a group of graphs showing average displacement, average velocity and current plotted against time for a ten round burst of the weapon system, according to an illustrative embodiment.

FIG. 6 is a group of graphs showing average displacement, average velocity and current plotted against time for a ten round burst of the weapon system, according to an illustrative embodiment. The inventors modeled the current generation for a RWS 3 over a ten round burst. Gas flow through the weapon system barrel 31 was modeled using complex computational fluid dynamic simulations to obtain inputs to a turbine model, namely the gas temperature, pressure and mass flow. The turbine model, outlined in FIG. 5, converts these input parameters into rotational speed and torque of the turbine shaft. The rotational speed and torque of the generator shaft in turn is fed into a model of a DC electric generator. The output of the DC electric generator model is shown in the graphs of FIG. 6. The first graph 62 shows the average displacement of angular displacement of the turbine wheel plotted over time. The second graph 64 shows the angular velocity of the turbine wheel plotted verses time. Finally, the third graph 66 shows the generated current plotted verses time. As shown, a ten round burst produces ten impulses on the blades and spins up the generator, producing current.

While the invention has been described with reference to certain embodiments, numerous changes, alterations and modifications to the described embodiments are possible without departing from the spirit and scope of the invention as defined in the appended claims, and equivalents thereof.

What is claimed is:

1. A power generation assembly for a remote weapon system comprising:

a gas distribution subassembly further comprising a gas tappet for receiving expanding propellant gases from a weapon system barrel, a right gas channel extending rearward in a right direction for directing propellant gas to a right converging nozzle and a left gas channel extending rearward in a left direction for directing propellant gas to a left converging nozzle;

a right radial inflow turbine operable via propellant gases received from the right converging nozzle and a left radial inflow turbine operable via propellant gases received from the left converging nozzle, said right radial inflow turbine and said left radial inflow turbine being diametrically opposed to each other across a driveshaft; and an electric generator further comprising the driveshaft about which a torque is imparted by the right radial inflow turbine and the left radial inflow turbine through an epicyclical gear arrangement, said driveshaft coupled to a magnet rotor rotatably suspended within a generator stator; and an electrical interface for transmitting an electric current produced by the magnet rotor rotating within the generator stator to trickle charge a battery.

* * * * *